US012291684B2

(12) United States Patent
Ramasamy et al.

(10) Patent No.: US 12,291,684 B2
(45) Date of Patent: May 6, 2025

(54) METHOD EMBODIMENTS FOR PARTIAL HYDROGENATION OF CARBOCYCLIC COMPOUNDS TO PRODUCE JET FUEL BLENDSTOCK

(71) Applicant: Battelle Memorial Institute, Richland, WA (US)

(72) Inventors: Karthikeyan Kallupalayam Ramasamy, West Richland, WA (US); Mond F. Guo, Richland, WA (US); Casper O. Brady, Pasadena, CA (US)

(73) Assignee: Battelle Memorial Institute, Richland, WA (US)

( * ) Notice: Subject to any disclaimer, the term of this patent is extended or adjusted under 35 U.S.C. 154(b) by 0 days.

(21) Appl. No.: 18/066,805

(22) Filed: Dec. 15, 2022

(65) Prior Publication Data

US 2023/0193148 A1 Jun. 22, 2023

Related U.S. Application Data

(60) Provisional application No. 63/290,514, filed on Dec. 16, 2021.

(51) Int. Cl.
*C10L 1/16* (2006.01)

(52) U.S. Cl.
CPC ..... *C10L 1/16* (2013.01); *C10L 2230/04* (2013.01); *C10L 2270/04* (2013.01)

(58) Field of Classification Search
CPC ..... C10L 1/16; C10L 2270/04
See application file for complete search history.

(56) References Cited

U.S. PATENT DOCUMENTS 8,975,463 B1 * 3/2015 Harvey ..... C10G 29/205 585/362
2009/0126260 A1 * 5/2009 Aravanis ..... C10G 3/49 208/113
2013/0225462 A1 * 8/2013 Di Biase ..... C10M 159/12 44/388
2014/0148623 A1 * 5/2014 McAuliffe ..... C07C 9/14 422/644

OTHER PUBLICATIONS

Rubulotta et al., "Highly Selective Hydrogenation of R-(+)-Limonene to (+)-p-1-Menthene in Batch and Continuous Flow Reactors," *ACS Sustainable Chemistry & Engineering*, 5(5): 3762-3767, Mar. 18, 2017.

* cited by examiner

*Primary Examiner* — Ellen M McAvoy
*Assistant Examiner* — Ming Cheung Po
(74) *Attorney, Agent, or Firm* — Klarquist Sparkman, LLP

(57) ABSTRACT

Disclosed herein are embodiments of a method for making jet fuel blendstocks that comprise partially hydrogenated carbocyclic compounds and which can be used to replace aromatic-containing fuels and that exhibit suitable seal swell properties. The disclosed method embodiments utilize catalysts and reaction conditions that facilitate partially hydrogenating carbocyclic compounds present in mixtures obtained from renewable sources, such as bio-based fermentation products. The reaction product mixtures obtained from the disclosed method can be blended with blendstocks to provide fuels that avoid soot formation caused by aromatic-containing fuels and that exhibit seal swelling that meet requirements in aviation systems.

20 Claims, 1 Drawing Sheet

METHOD EMBODIMENTS FOR PARTIAL HYDROGENATION OF CARBOCYCLIC COMPOUNDS TO PRODUCE JET FUEL BLENDSTOCK

CROSS REFERENCE TO RELATED APPLICATION

This application claims the benefit of and priority to the earlier filing date of U.S. Provisional Patent Application No. 63/290,514, filed on Dec. 16, 2021, the entirety of which is incorporated herein by reference in its entirety.

ACKNOWLEDGMENT OF GOVERNMENT SUPPORT

This invention was made with government support under DE-AC0576RL01830 awarded by the U.S. Department of Energy. The government has certain rights in the invention.

FIELD

The present disclosure is directed to a method for partially hydrogenating carbocyclic compounds, such as terpenes, to produce jet fuel blendstocks.

BACKGROUND

Developing sustainable aviation fuel production technologies is important to decarbonizing the aviation industry; however, the chemical requirements for "drop-in" sustainable fuels (that is, fuels that do not need to be blended with petroleum-based fuels to be compatible with modern aviation engines) are stringent. One particular barrier to implementing current sustainable aviation fuels is incompatibility of these fuels with O-rings present in aviation systems. Conventional aviation O-rings are designed to swell during operation to provide adequate sealing. This swelling occurs due to a high concentration of aromatic hydrocarbons in conventional petroleum derived fuels. The vast majority of sustainable aviation fuel production technologies do not produce significant amounts of aromatic hydrocarbons, imposing a significant hurdle to producing true drop-in fuels. Aromatic compounds present in conventional fuels also cause soot formation during combustion, imposing an environmental need to reduce the amount of aromatics present in fuels. There exists a need in the art for new routes to provide new feedstocks that can be used to produce jet fuel blendstocks, such as sustainable processes that can produce non-aromatic compounds with similar seal swelling character to aromatics.

SUMMARY

Disclosed herein are embodiments of a method for producing a jet fuel blendstock, comprising: introducing a feedstock comprising a first carbocyclic compound comprising at least two sites of unsaturation into a reactor comprising a hydrogenation catalyst; introducing a gas into the reactor; operating the reactor at a reaction temperature and under a reaction pressure sufficient to promote forming a reaction product mixture comprising amounts of (i) a partially hydrogenated form of the first carbocyclic compound such that one of the at least two sites of unsaturation is hydrogenated; and (ii) the first carbocyclic compound; and/or (iii) a fully hydrogenated form of the first carbocyclic compound; and isolating the reaction product mixture; provided that if the first carbocyclic compound is limonene, then the feedstock comprises one or more further carbocyclic compounds other than limonene.

In some particular embodiments, the method comprises introducing a feedstock comprising one or more terpenes into a reactor comprising Pt/C; introducing $H_2$ into the reactor; operating the reactor at a reaction temperature ranging from ambient temperature to 200° C. and under a reaction pressure ranging from 0 psig to 600 psig to form a reaction product mixture comprising amounts of (i) a partially hydrogenated form of the terpenes such that a non-cyclic site of unsaturation of the terpenes is hydrogenated; and (ii) a fully hydrogenated form of the terpene; and isolating the reaction product mixture; provided that if the terpene is limonene, then the feedstock comprises one or more terpenes other than limonene.

The foregoing and other objects, features, and advantages of the present disclosure will become more apparent from the following detailed description, which proceeds with reference to the accompanying figures.

DETAILED DESCRIPTION

Overview of Terms

Figure 1:
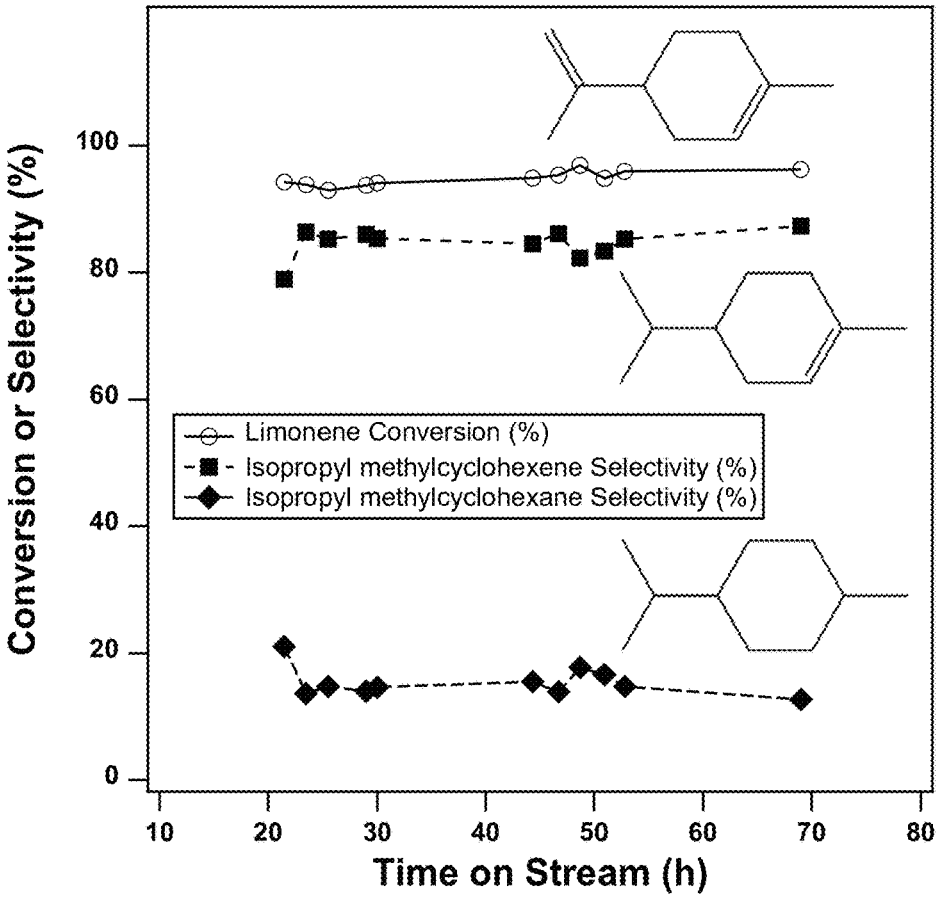
FIG. 1 is a graph of conversion/selectivity (%) as a function of time on stream (hours) showing conversion and/or selectivity rates observed using a method embodiment according to the present disclosure to partially hydrogenate a limonene-containing feedstock.

The following explanations of terms and abbreviations are provided to better describe the present disclosure and to guide those of ordinary skill in the art in the practice of the present disclosure. As used herein, "comprising" means "including" and the singular forms "a" or "an" or "the" include plural references unless the context clearly dictates otherwise. The term "or" refers to a single element of stated alternative elements or a combination of two or more elements, unless the context clearly indicates otherwise.

Unless explained otherwise, all technical and scientific terms used herein have the same meaning as commonly understood to one of ordinary skill in the art to which this disclosure belongs. Although methods and materials similar or equivalent to those described herein can be used in the practice or testing of the present disclosure, suitable methods and materials are described below. The materials, methods, and examples are illustrative only and not intended to be limiting. Other features of the disclosure are apparent from the following detailed description and the claims.

The disclosure of numerical ranges should be understood as referring to each discrete point within the range, inclusive of endpoints, unless otherwise noted. Unless otherwise indicated, all numbers expressing quantities of components, molecular weights, percentages, temperatures, times, and so forth, as used in the specification or claims are to be understood as being modified by the term "about." Accordingly, unless otherwise implicitly or explicitly indicated, or unless the context is properly understood by a person of ordinary skill in the art to have a more definitive construction, the numerical parameters set forth are approximations that may depend on the desired properties sought and/or limits of detection under standard test conditions/methods as known to those of ordinary skill in the art. When directly and explicitly distinguishing embodiments from discussed prior art, the embodiment numbers are not approximates unless the word "about" is recited.

Also, the following description is exemplary in nature and is not intended to limit the scope, applicability, or configuration of the present disclosure. Various changes to the described embodiment may be made in the function and arrangement of the elements described herein without departing from the scope of the preset disclosure. Further, descriptions and disclosures provided in association with one particular embodiment are not limited to that embodiment, and may be applied to any embodiment disclosed. Further, the terms "coupled" and "associated" generally mean fluidly, electrically, and/or physically (e.g., mechanically or chemically) coupled or linked and does not exclude the presence of intermediate elements between the coupled or associated items absent specific contrary language.

Although the operations of exemplary embodiments of the disclosed method and/or system embodiments may be described in a particular, sequential order for convenient presentation, it should be understood that disclosed embodiments can encompass an order of operations other than the particular, sequential order disclosed, unless the context dictates otherwise. For example, operations described sequentially may in some cases be rearranged or performed concurrently. Further, descriptions and disclosures provided in association with one particular embodiment are not limited to that embodiment, and may be applied to any disclosed embodiment.

To facilitate review of the various embodiments of the disclosure, the following explanations of specific terms are provided.

Carbocyclic Compound: A cyclic compound consisting of carbon and hydrogen atoms.

Cyclic Site of Unsaturation: A site of unsaturation (e.g., double or triple bond) positioned within a ring system. For example, the compound illustrated below has a cyclic site of unsaturation:

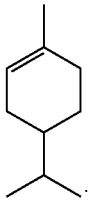

Full Hydrogenation: A result of using a method according to the present disclosure wherein a compound comprising at least two sites of unsaturation (e.g., two double bonds, two triple bonds, or both a double and triple bond) is converted to a product comprising no sites of unsaturation.

Jet Fuel and Jet-Range Hydrocarbons: A hydrocarbon or hydrocarbon mixture that distills in the range from about 120° C. to about 300° C., and typically includes hydrocarbons with a carbon number between about C8 and about C16. Actual range limits for commercial use depend on numerous other required fuel properties. Thus, no limitations are intended unless indicated otherwise herein.

Non-Cyclic Site of Unsaturation: A site of unsaturation (e.g., double or triple bond) positioned externally to a ring system. For example, the two compounds illustrated below each have a cyclic site of unsaturation:

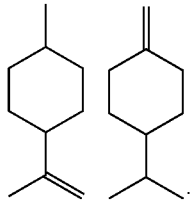

Partial Hydrogenation: A result of using a method according to the present disclosure wherein a compound comprising at least two sites of unsaturation (e.g., two double bonds, two triple bonds, or both a double and triple bond) is converted to a product comprising at least one fewer sites of unsaturation, but is not fully saturated.

Terpene: An unsaturated hydrocarbon compound having a formula $(C_5H_8)_n$ for n>1 and that is cyclic. Terpenes according to the present disclosure typically are cyclic monoterpenes ($C_{10}$) and thus comprise two isoprene units in the form of a carbocycle. In some embodiments, however, the terpenes can be sesquiterpenes ($C_{15}$) and/or diterpenes ($C_{20}$). In particular embodiments, the terpenes contemplated by the present disclosure are hydrocarbons and are not, or are other than, terpenoids.

Introduction

Under ASTM D1655 requirements, jet fuel should contain between 8-25% aromatic compounds in the fuel composition to maintain the O-ring elastomer seal swell properties observed with the presence of such aromatic compounds; however, aromatics present in the jet fuel contributes to soot formation, typically resulting from the poor hydrogen to carbon ratio in aromatic compounds. This ratio leads to the contrails, a precursor for the global warming impact. To achieve a 100% drop in fuel goal to achieve net zero emissions, alternatives to aromatics should be identified. Aromatics from renewable feedstocks can only eliminate $CO_2$, which is only ~50% of the global warming impact from the aviation sector.

While cycloalkanes could serve as a potential replacement for aromatics, given their higher hydrogen to carbon ratio, very limited work has been conducted in the art on cycloalkanes suitability as an aromatic replacement that initiates the necessary seal swell in aviation applications. To achieve such an aromatic alternative, a large fraction of cycloalkanes typically is needed in the jet fuel mixtures (e.g., higher than 25%) to achieve a similar seal swelling performance; however, there are limited pathways that could produce such mixtures that also meet distillation curve requirements/performance while maintaining compositional features.

Disclosed herein are embodiments of a new method that uses alternative feedstocks to achieve carbocyclic alternatives to aromatics that exhibit desirable seal swell capabilities. Method embodiments disclosed herein can be used with a range of feedstocks, including those comprising terpene compounds and isomers thereof. The method embodiments of the present disclosure utilize reaction conditions and catalyst embodiments that facilitate obtaining compound mixtures that comprise at least one compound that is partially hydrogenated (relative to the corresponding starting compound). In particular embodiments, the method provides products that comprise compound mixtures wherein compounds that are both partially and fully hydrogenated are generated. The method can be tuned to provide product mixtures that have particular desired ratios of partially:fully hydrogenated compounds. Reaction product mixtures made according to the disclosed method embodiments can be used as fuel blendstocks to provide fuel compositions that exhibit desired seal swelling properties. Yet another advantage of the disclosed method is that commonly produced bio-intermediates (e.g., terpenes) can be utilized as feedstocks, thus lending the method to a wide variety of feedstocks for use in arriving at fuels having desirable seal swelling properties.

Method Embodiments

Disclosed herein are embodiments of a method for making compound mixtures comprising partially hydrogenated carbocyclic compounds from various types of feedstocks, including feedstocks comprising terpene compounds (and isomers thereof) and other non-aromatic carbocyclic compounds comprising at least two sites of unsaturation (e.g., at least two double bonds, at least two triple bonds, or at least one double bond and one triple bond) within the compound's structure. The compound mixture obtained from the method can be used as a fuel blendstock for arriving at jet fuel compositions. In some embodiments, the sites of unsaturation of the feedstock compounds can be cyclic sites of unsaturation (that is, wherein the site of unsaturation is positioned within a ring of the compound structure), non-cyclic sites of unsaturation (that is, wherein the site of unsaturation is positioned external to any ring of the compound structure and/or present in any non-cyclic compound), or combinations thereof. In some embodiments, feedstocks can comprise one or more such compounds, but typically include a mixture of the carbocyclic compounds. In some embodiments, the mixture of carbocyclic compounds includes mixtures comprising two or more terpene compounds. In some embodiments, the feedstock comprises a mixture of three or more carbocyclic compounds, such as four, five, six, seven, or more carbocyclic compounds. In an independent embodiment, the feedstock does not consist of limonene.

In particular embodiments, the method comprises introducing a feedstock comprising a first carbocyclic compound comprising at least two sites of unsaturation into a reactor comprising a hydrogenation catalyst; introducing a gas into the reactor; operating the reactor at a reaction temperature and under a reaction pressure sufficient to promote forming a reaction product mixture comprising amounts of (i) a partially hydrogenated form of the first carbocyclic compound such that one of the at least two sites of unsaturation is hydrogenated; and (ii) the first carbocyclic compound; and/or (iii) a fully hydrogenated form of the first carbocyclic compound such that all sites of unsaturation are hydrogenated; and isolating the reaction product mixture. In some embodiments of the method, if the first carbocyclic compound is limonene, then the feedstock comprises one or more further carbocyclic compounds other than limonene, such as one or more limonene isomers.

The reaction pressure can range from 0 psig to 600 psig, such as 50 psig to 400 psig, such as 50 psig to 350 psig, or 100 psig to 300 psig. In particular embodiments, the pressure is 300 psig.

The reaction temperature can range from ambient temperature to 200° C., such as ambient temperature to 150° C., or such as ambient temperature to 100° C., or ambient temperature to 80° C., or ambient temperature to 70° C., or ambient temperature to 60° C., or ambient temperature to 50° C. In particular examples, the temperature is ambient temperature, 50° C., or 100° C.

The flow rate of any feedstock can be controlled to provide a weight head space volume (WHSV, $h^{-1}$) ranging from 0.1 $hr^{-1}$ to 6 $hr^{-1}$, such as 0.1 $hr^{-1}$ to 4 $hr^{-1}$, or 0.2 $hr^{-1}$ to 4 $hr^{-1}$, or 0.2 to 3.5 $hr^{-1}$. In particular embodiments, the WHSV of the feedstock is 3.0 $hr^{-1}$ or 1.2 $hr^{-1}$.

The gas typically is a gas capable of facilitating hydrogenating a site of unsaturation to produce a site of full saturation, or a site having less unsaturation that prior to exposure to the gas. For example, in some embodiments, the site of unsaturation that is hydrogenated can be a double bond, which is hydrogenated to a single bond. In some other embodiments, the site of unsaturation that is hydrogenated can be a triple bond, which is hydrogenated to either a double bond or to a single bond. In some embodiments, the gas is hydrogen gas (or $H_2$).

The catalyst material typically is a heterogenous catalyst. In particular embodiments, the catalyst material comprises a metal component and a support component. The metal component can be selected from a platinum group metal, such as ruthenium, rhodium, palladium, osmium, iridium, platinum, or a combination thereof. In particular embodiments, the metal component is platinum, palladium, or ruthenium. The support component typically is a suitable material upon which metal can be deposited, such as an activated carbon or a metal oxide material, such as aluminum oxides (e.g., $Al_2O_3$), silicon oxides (e.g., $SiO_2$), zirconium oxides (e.g., $ZrO_2$), and titanium oxides (e.g., $TiO_2$). In particular embodiments, the catalyst is palladium on carbon (or "Pd/C"), platinum on carbon (or "Pt/C"), platinum on a metal oxide (e.g., $Pt/ZrO_2$, $Pt/SiO_2$, $Pt/Al_2O_3$, $Pt/TiO_2$), or ruthenium on carbon (or "Ru/C") or a metal oxide support (e.g., $Ru/Al_2O_3$ or $Ru/SiO_2$).

The amount of the catalyst material used in the method can be a catalytic amount or a stoichiometric amount. In particular embodiments, the catalyst material is provided on a catalyst bed that is used in a flow reactor or a batch reactor such that the feedstock is allowed to come into contact with the catalyst material. The method can be performed as a batch method or as a flow method using a suitable flow reactor. The catalyst can be replaced with fresh catalyst or it can be regenerated using techniques known in the art. The feedstock can be introduced into a reactor (batch or flow reactor) using an inlet and suitable connections and pumps to facilitate introducing the feedstock into the reactor. The gas also can be introduced into the reactor. The gas can be introduced concurrently or sequentially with the feedstock. In some embodiments, the gas and feedstock can be mixed together and then introduced into the reactor. In some embodiments, the flow rate of the feedstock, the gas, or both can be adjusted to allow sufficient exposure of the feedstock and gas to the catalyst material so as to facilitate hydrogenation, particularly partial hydrogenation. In yet other embodiments, the pressure of the reactor can be controlled by controlling the pressure of the gas used. The reaction can be monitored by collecting a sample from the reactor and performing a suitable analysis technique to determine the ratio of products after a certain time period of exposure. In some embodiments, gas chromatography can be used to evaluate reaction mixtures.

In some embodiments, the reaction product mixture produced from the method includes a mixture of compounds that are partially hydrogenated relative to the compounds of the feedstock. In yet some further embodiments, the reaction product mixture produced from the method includes a mixture of compounds that are (i) partially hydrogenated and (ii) fully hydrogenated and/or unreacted (with no hydrogenation). For example, the method can comprise making and isolating a reaction product mixture that comprises partially hydrogenated products and fully hydrogenated products. In yet other embodiments, the reaction product mixture comprises partially hydrogenated products, fully hydrogenated products, and unreacted products.

In some embodiments, conditions of and/or reagents used in the method are modified to control a ratio of partially hydrogenated compounds to fully hydrogenated compounds obtained in the product mixture. In some embodiments, the temperature is modified to obtain a desired ratio of partially hydrogenated compounds to fully hydrogenated compounds. In some other embodiments, the flow rate of a feedstock is modified to obtain a desired ratio of partially hydrogenated compounds to fully hydrogenated compounds. In some other embodiments, the amount and/or identity of the catalyst material is modified to obtain a desired ratio of partially hydrogenated compounds to fully hydrogenated compounds. In yet some other embodiments, reaction time is modified to obtain a desired ratio of partially hydrogenated compounds to fully hydrogenated compounds. In exemplary embodiments, the ratio of partially hydrogenated compounds to fully hydrogenated compounds in the product mixture can range from 1:9 (partial:full) to 19:1 (partial:full), such as 1:9, 1:3, 1:1.86, 1:1, 2:1, 5:1, 10:1, 15:1, or 19:1. In some embodiments, the partially hydrogenated compound can be present at a percentage of 90% or higher, such as 95% or higher. In embodiments comprising a product mixture of partially hydrogenated products, fully hydrogenated products, and unreacted products, the ratio of the mixture can range from 1:1:1.5 (partial:unreacted:full) to 11:1:13 (partial:unreacted:full), such as 1.32:1:1.68, 2.8:1:2.9, 6.5:1:1.6, 5.9:1:4.2, and 11:1:13.

In some embodiments, the feedstock can be prepared from a starting material that is derived from a renewable source. Solely by way of example, the feedstock can be prepared from isoprene or other unsaturated hydrocarbons that is directly or indirectly derived from a renewable source like bio-based fermentation. In embodiments where the feedstock is produced from a starting material, the method of the present disclosure can further comprise reacting the starting material so as to facilitate dimerization of the starting material to provide a feedstock comprising a mixture of terpenes and/or polymers. In some such embodiments, the starting material can be introduced into a reactor and exposed to a temperature sufficient to thermally dimerize the starting material. The temperature can range from greater than ambient temperature to 200° C., such as 80° C. to 190° C., or 100° C. to 180° C., or 100° C. to 170° C. The reactor can be operated under a suitable pressure. In some embodiments, the reactor is operated at a pressure of 500 psig. In some embodiments, the method can further comprise introducing a polymerization inhibitor into the reactor either simultaneously or sequentially with the starting material. In particular embodiments, the starting material can be isoprene and the polymerization inhibitor can be tert-butyl catechol (or "TBC"). The reactor can be an up-flow liquid phase reactor. In particular embodiments using isoprene as the starting material, the reactor can be operated at a temperature of 170° C. and a pressure of 500 psig. A schematic illustrating this representative embodiment is shown in FIG. 1. In some embodiments using isoprene as the starting material, a mixture of terpenes can be obtained as the feedstock, including, but not limited to, isomers of limonene, limonene, cadinene, pinene, humulene, neocembrene, sclarene, dimethyl cyclooctadiene, and the like (including combinations thereof).

In some embodiments, reaction product mixtures obtained using method embodiments described herein can be blended with other compounds and/or fuels. In some embodiments, the reaction product mixtures of the present disclosure can be blended with non-aromatic hydrotreated esters and fatty acids (or "HEFA" fuels). When used for blending the reaction product mixture can be added to a base blendstock (e.g., a HEFA fuel) in amounts ranging from 10% vol/vol to 50% vol/vol. The reaction product mixtures, blended or neat, exhibit seal swelling values that satisfy current material compatibility requirements for currently operational aircraft. In particular embodiments, the reaction product mixtures can provide seal swelling values ranging from 1 to 50% v/v seal swell, such as 5 to 25% v/v seal swell, or 10 to 20% v/v seal swell. In some embodiments, a fuel blend comprising the reaction product mixture in an amount as low as 10% can exhibit 8-12% v/v seal swell.

Overview of Several Embodiments

Disclosed herein are embodiments of a method for producing a jet fuel blendstock, comprising: introducing a feedstock comprising a first carbocyclic compound comprising at least two sites of unsaturation into a reactor comprising a hydrogenation catalyst; introducing a gas into the reactor; operating the reactor at a reaction temperature and under a reaction pressure sufficient to promote forming a reaction product mixture comprising amounts of (i) a partially hydrogenated form of the first carbocyclic compound such that one of the at least two sites of unsaturation is hydrogenated; and (ii) the first carbocyclic compound; and/or (iii) a fully hydrogenated form of the first carbocyclic compound; and isolating the reaction product mixture; provided that if the first carbocyclic compound is limonene, then the feedstock comprises one or more further carbocyclic compounds other than limonene.

In any or all embodiments, the feedstock comprises a mixture of carbocyclic compounds, wherein each additional carbocyclic compound is different from the first carbocyclic compound.

In any or all embodiments, the first carbocyclic compound is a limonene isomer, limonene, or dimethyl cyclooctadiene.

In any or all embodiments, the hydrogenation catalyst is a heterogenous catalyst.

In any or all embodiments, the heterogenous catalyst comprises (i) a metal component selected from a platinum group metal and (ii) a support component.

In any or all embodiments, the heterogenous catalyst is Pt/C, Pd/C, Ru/C, $Pt/ZrO_2$, $Pt/SiO_2$, $Pt/Al_2O_3$, or a mixture thereof.

In any or all embodiments, the gas is hydrogen.

In any or all embodiments, the reaction temperature ranges from ambient temperature to 200° C. and the reaction pressure ranges from 0 psig to 300 psig.

In any or all embodiments, the reaction product mixture comprises the partially hydrogenated form of the first carbocyclic compound, the first carbocyclic compound, and the fully hydrogenated form of the first carbocyclic compound.

In any or all embodiments, the reaction product mixture comprises a ratio of the partially hydrogenated form of the first carbocyclic compound : the first carbocyclic compound : the fully hydrogenated form of the first carbocyclic compound that ranges from 1:1:1.5 to 11:1:13.

In any or all embodiments, the reaction product mixture comprises the partially hydrogenated form of the first carbocyclic compound and the fully hydrogenated form of the first carbocyclic compound.

In any or all embodiments, the reaction product mixture comprises a ratio of the partially hydrogenated form of the first carbocyclic compound:the fully hydrogenated form of the first carbocyclic compound that ranges from 1:9 to 19:1.

In any or all embodiments, the first carbocyclic compound comprises two sites of unsaturation, wherein one site of unsaturation is a non-cyclic site of unsaturation and the second site of unsaturation is a cyclic site of unsaturation.

In any or all embodiments, the cyclic site of unsaturation is not hydrogenated in the partially hydrogenated form of the first carbocyclic compound.

In any or all embodiments, the reaction product mixture comprises a mixture of 1-isopropyl-4-methylcyclohexane, 1-isopropyl-3-methylcyclohexane, 1,5-dimethylcyclooctane, 4-isopropyl-1-methylcyclohex-1-ene, 5-isopropyl-1-methylcyclohex-1-ene, and (Z)-1,5-dimethylcyclooct-1-ene.

In any or all embodiments, the method further comprises preparing the feedstock from a starting material that is derived from a renewable source.

In any or all embodiments, the starting material is isoprene and the method comprises introducing the isoprene into a reactor and thermally dimerizing the isoprene to provide a mixture of terpene and/or polymer compounds that includes the first carbocyclic compound.

In any or all embodiments, the method comprises: introducing a feedstock comprising one or more terpenes into a reactor comprising Pt/C; introducing $H_2$ into the reactor; operating the reactor at a reaction temperature ranging from ambient temperature to 200° C. and under a reaction pressure ranging from 0 psig to 600 psig to form a reaction product mixture comprising amounts of (i) a partially hydrogenated form of the terpenes such that a non-cyclic site of unsaturation of the terpenes is hydrogenated; and (ii) a fully hydrogenated form of the terpene; and isolating the reaction product mixture; provided that if the terpene is limonene, then the feedstock comprises one or more terpenes other than limonene.

In any or all embodiments, the feedstock is obtained from dimerizing isoprene and the terpene is a limonene isomer.

EXAMPLES

Example 1

In this example, a starting material obtained from a renewable source was converted to a feedstock. In particular, pure isoprene was reacted in an up-flow liquid phase reactor where pure isoprene is dimerized thermally at 170 C ° C. and 500 psig. This reaction was co-fed with a small amount (~4000 ppm) of a common isoprene polymerization inhibitor (tert-butyl catechol (TBC)) in order to prevent excessive polymerization during dimerization. The produced "crude" terpene product was further refined by filtration (to remove produced polyisoprene) and vacuum distillation (to remove unreacted isoprene). The resulting mixture obtained after the distillation product comprised a mix of five primary products, which included isomers of limonene and dimethyl cyclooctadiene.

Example 2

In this example, partial hydrogenation of the terpene feedstock from Example 1, as well as pure limonene, was performed in a downflow packed bed reactor. The catalyst was placed in the middle of the reactor tube in an isothermal zone and heated using a steel heat block and band heater to the desired reaction temperature. Catalysts were obtained commercially or prepared by incipient wetness using Pt nitrate salts on commercial NORIT ROX carbon supports followed by air drying. The feedstock was fed using an HPLC pump from the top of the reactor along with hydrogen as a gas feed. Elevated system pressure was maintained using a spring-loaded back pressure regulator. The liquid product samples were collected at the bottom of the reactor in a cold trap at ~4° C. The products were speciated via gas chromatography-mass spectroscopy (GC-MS) and quantified with a flame-ionization detector (FID) using internal/external standards. The reactor was operated between 50-300 psig system pressure. The temperature of the reaction was between 25° C. to 100° C. The weight hourly space velocity was varied between 0.2-3.5 $hr^{-1}$. The molar ratio of hydrogen to terpene was varied between 2 and 5.

The greater number of starting compounds in the terpene mixture resulted in a more diverse set of products, with some of the most prominent compounds shown as examples in Table 1. Partial hydrogenation however was consistently observed on the alkyl chain (external site of unsaturation) while unsaturation was retained on the ring (internal site of unsaturation).

TABLE 1

Categorization of Compounds in Mixture after Partial Hydrogenation Reaction

| Fully Hydrogenated | Partially Hydrogenated | No Hydrogenation |
|---|---|---|

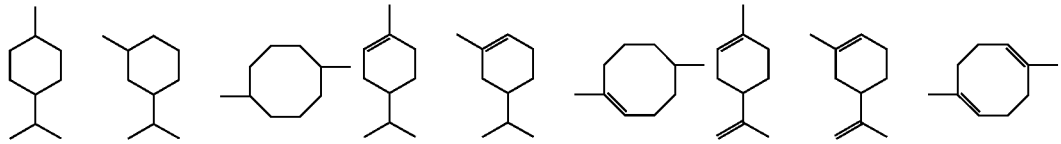

Different mixtures of unsaturated, partially saturated, and fully saturated terpene-derived products were obtained depending on the partial hydrogenation reaction conditions. Some of the mixture compositions are listed in Table 2 below.

TABLE 2

Composition of Mixtures Following Partial Hydrogenation Reaction

| Mixture | Fully Hydrogenated | Partially Hydrogenated | No Hydrogenation |
|---|---|---|---|
| #1 | 42% | 33% | 25% |
| #2 | 43% | 42% | 15% |
| #3 | 52% | 44% | 4% |

TABLE 2-continued

| Composition of Mixtures Following Partial Hydrogenation Reaction | | | |
|---|---|---|---|
| Mixture | Fully Hydrogenated | Partially Hydrogenated | No Hydrogenation |
| #4 | 38% | 53% | 9% |
| #5 | 18% | 71% | 11% |

Example 3

In this example, seal swell analysis was conducted on Mixture #3 from Example 2. Seal swell testing is used to determine the material compatibility of the fuel mixture with acrylonitrile-butadiene O-ring representative of those used in aviation applications. Seal swell testing was conducted using an in-house optical dilatometry device, which optically measures the expansion of the inner diameter of the O-ring continuously over the course of several days/weeks when submerged in the testing sample. The test concludes upon convergence of the measured diameter to a stable value, which is expressed as a % volume/volume seal swell of the O-ring. For non-neat samples, non-aromatic hydrotreated esters and fatty acids (HEFA) fuel sourced from World Energy was used as the base blendstock to produce the various blended seal swell test results reported here. The tested samples were typically blended in the 10-50% volume/volume range, with limitations only by the relative opacity of the sample needed for the optical dilatometry.

The results for the seal swell analysis for the terpene Mixture #3 from Example 2 was obtained at 10% v/v blending, which yielded ~8-12% v/v seal swell. This degree of seal swelling is sufficient to satisfy current material compatibility requirements for currently operational aircraft and appears to be accomplished by significantly less blending than typically required, even compared to the pure limonene test sample. These results suggest that bio-based partially hydrogenated cyclic mixtures could be highly suitable as blendstocks to achieve high material compatibility in sustainable aviation fuel.

Example 4

All reactions in this example were performed in a ~0.3 inch inner diameter up flow reactor. Limonene flow was established via a standard HPLC piston pump and was premixed with $H_2$ gas introduced by a mass flow controller before entering a reaction zone heated by a PID controlled heating mantle. A commercial Pt/C (pressed and sieved between 30 and 100 mesh) catalyst was packed in the heated zone and the reaction pressure was controlled via a downstream back pressure regulator through which both liquid and gas products flowed. The liquid products were collected intermittently in a cold trap and analyzed by gas chromatography to evaluate conversion and selectivity values.

Figure 2:
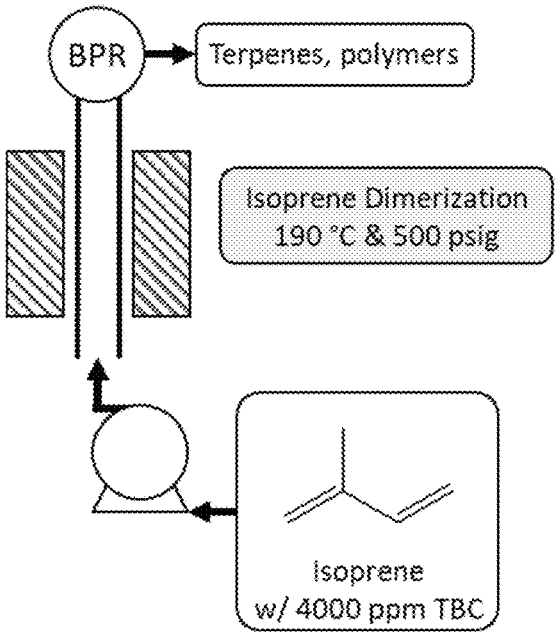
FIG. 2 is a schematic diagram showing how isoprene can be converted to a feedstock comprising terpenes used for method embodiments according to present disclosure.

In a first example, the temperature of the reaction zone was maintained at ambient temperature and a pressure of $H_2$ of 300 psi, with a WHSV of limonene of 3.0. In a second example, the temperature of the reaction zone was maintained at 50° C. and a pressure of $H_2$ of 300 psi, with a WHSV of limonene of 3.0. Results for this example are shown in FIG. 2. In a third example, the temperature of the reaction zone was maintained at 100° C. and a pressure of $H_2$ of 300 psi, with a WHSV of limonene of 1.2. Conditions of the three examples discussed above are summarized in Table 3.

TABLE 3

| Example | Temperature (° C.) | Pressure (psig) | Limonene WHSV ($h^{-1}$) |
|---|---|---|---|
| 1 | 25 | 300 | 3.0 |
| 2 | 50 | 300 | 3.0 |
| 3 | 100 | 300 | 1.2 |

After collection, the seal swell character of the produced hydrocarbon mixture for each of the three examples discussed above was determined by submerging a nitrile O-ring in the hydrocarbon mixture and quantifying the swelling of the O-ring via optical dilatometry. Results are shown in Table 4, along with results obtained from analyzing a composition comprising pure limonene (as a comparison).

TABLE 4

| Example | Limonene | Isopropyl methyl-cyclohexene | Isopropyl methyl-cyclohexane | Measured Nitrile O-ring Volume Swell (v/v %) |
|---|---|---|---|---|
| 1 | 10% | 63% | 27% | 22.6% |
| 2 | 5% | 82% | 13% | 23.0% |
| 3 | 0% | 8% | 92% | 5.2% |
| Pure limonene | 100% | 0% | 0% | 41.9% |

The seal swelling character of traditional petroleum aviation fuels is generally attributed to the aromatic content intrinsic in the fuel. Pure limonene is observed to have slightly lower swelling character compared to aromatic compounds (generally, fuels with aromatic concentration of ~10-25% swell nitrile O-rings by ~9-17 v/v %). As shown in Table 4, pure limonene was observed to swell nitrile O-rings by 41.9%.

The seal swell character of fully hydrogenated limonene (isopropyl methylcyclohexane) is significantly lower than limonene. Given that aviation engines require O-rings to swell significantly more than was observed for nearly pure isopropyl methylcyclohexane it currently is believed that fully saturated terpenes, alone, may not be a viable strategy for producing suitable blend stocks for paraffinic sustainable fuels. The seal swell tests of the hydrocarbon mixtures produced in Tests 1 and 2, however, demonstrate that partially saturated limonene possesses a significant seal swelling character. While this compound clearly swells nitrile rubber less than limonene itself, the fact that the pure compound swells seals more than typical Jet A, indicates that mixtures of partially hydrogenated terpenes mixed with paraffinic sustainable fuels will likely be compatible with current aviation engine O-rings. Partially saturated terpenes are also likely to produce less soot than aromatics or terpenes during combustion due to the higher hydrogen to carbon ratio.

Example 5

In this example, isoprene-derived terpene mixtures were produced as detailed in Example 1 herein and were partially hydrogenated using catalyst embodiments described in Table 5 below using different metals and supports. As can be seen by the information in Table 5, fuel blendstocks of interest can be produced by a wide range of catalysts.

TABLE 5

Comparison of Catalysts for Partial Hydrogenation of Terpene Mixtures

| Catalyst | Fully Hydrogenated | Partially Hydrogenated | No Hydrogenation |
|---|---|---|---|
| Pd/C | 8.9% | 24.3% | 66.9% |
| Ru/C | 59.0% | 35.9% | 5.1% |
| $Pt/ZrO_2$ | 7.5% | 80.9% | 10.6% |
| $Pt/SiO_2$ | 60.7% | 18.3% | 9.1% |
| $Pt/Al_2O_3$ | 5.0% | 76.7% | 18.3% |

In view of the many possible embodiments to which the principles of the present disclosure may be applied, it should be recognized that the illustrated embodiments are only preferred examples of the disclosure and should not be taken as limiting the scope of the present disclosure. Rather, the scope is defined by the following claims. We therefore claim as our invention all that comes within the scope and spirit of these claims.

We claim:

1. A method for producing a jet fuel or a jet fuel blendstock, comprising:

introducing a feedstock comprising a first carbocyclic compound comprising at least two sites of unsaturation into a reactor comprising a hydrogenation catalyst;

introducing a gas into the reactor;

operating the reactor at a reaction temperature and under a reaction pressure sufficient to promote forming a reaction product mixture comprising (i) at least one partially hydrogenated carbocyclic product selected from 4-isopropyl-1-methylcyclohex-1-ene, 5-isopropyl-1-methylcyclohex-1-ene, or a combination thereof, present in an amount ranging from 11% to an amount that is 95% or higher of the reaction product mixture and (ii) the first carbocyclic compound and/or a fully hydrogenated form of the first carbocyclic compound; and isolating the reaction product mixture, wherein the reaction product mixture is the jet fuel or jet fuel blendstock;

wherein the jet fuel or the jet fuel blendstock thereof exhibits an O-ring seal swelling value ranging from 5% to 25% v/v seal swell provided that if the first carbocyclic compound is limonene, then the feedstock comprises one or more further carbocyclic compounds other than limonene.

2. The method of claim 1, wherein the feedstock comprises a mixture of carbocyclic compounds, wherein each additional carbocyclic compound is different from the first carbocyclic compound.

3. The method of claim 2, wherein the mixture of carbocyclic compounds comprises a limonene isomer, limonene, or dimethyl cyclooctadiene, or any combination thereof.

4. The method of claim 1, wherein the hydrogenation catalyst is a heterogenous catalyst.

5. The method of claim 4, wherein the heterogenous catalyst comprises (i) a metal component selected from a platinum group metal and (ii) a support component.

6. The method of claim 4, wherein the heterogenous catalyst is Pt/C, Pd/C, Ru/C, $Pt/ZrO_2$, $Pt/SiO_2$, $Pt/Al_2O_3$, or a mixture thereof.

7. The method of claim 1, wherein the gas is hydrogen.

8. The method of claim 1, wherein the reaction temperature ranges from ambient temperature to 200° C. and the reaction pressure ranges from 0 psig to 300 psig.

9. The method of claim 1, wherein the reaction product mixture comprises the partially hydrogenated product, the first carbocyclic compound, and the fully hydrogenated form of the first carbocyclic compound.

10. The method of claim 1, wherein the reaction product mixture is the jet fuel blendstock and the method further comprises making a blended fuel by mixing the jet fuel blendstock with a base blendstock, wherein the jet fuel blendstock is present in the blended fuel in an amount ranging from 10% vol/vol to 50% vol/vol.

11. The method of claim 1, wherein the reaction product mixture comprises the partially hydrogenated product and the fully hydrogenated form of the first carbocyclic compound.

12. The method of claim 1, wherein the jet fuel or the jet fuel blendstock exhibits a seal swelling value ranging from 10% to 25% v/v seal swell.

13. The method of claim 1, wherein the first carbocyclic compound comprises two sites of unsaturation, wherein one site of unsaturation is a non-cyclic site of unsaturation and the second site of unsaturation is a cyclic site of unsaturation.

14. The method of claim 1, wherein the at least one partially hydrogenated carbocyclic product selected from 4-isopropyl-1-methylcyclohex-1-ene, 5-isopropyl-1-methylcyclohex-1-ene, or a combination thereof, is present in an amount ranging from greater than 40% to an amount that is 95% or higher of the reaction product mixture; and wherein the seal swelling value is determined using an optical dilatometry device to measure an inner diameter expansion of an acrylonitrile-butadiene O-ring submerged in the jet fuel or the jet fuel blendstock.

15. The method of claim 1, wherein the reaction product mixture comprises a mixture of 1-isopropyl-4-methylcyclohexane, 1-isopropyl-3-methylcyclohexane, 1,5-dimethylcyclooctane, 4-isopropyl-1-methylcyclohex-1-ene, 5-isopropyl-1-methylcyclohex-1-ene, and (Z)-1,5-dimethylcyclooct-1-ene.

16. The method of claim 1, further comprising preparing the feedstock from a starting material that is derived from a renewable source.

17. The method of claim 16, wherein the starting material is isoprene and the method comprises introducing the isoprene into a reactor and thermally dimerizing the isoprene to provide a mixture of terpene and/or polymer compounds that includes the first carbocyclic compound.

18. A method for producing a jet fuel or a jet fuel blendstock, comprising:

introducing a feedstock comprising one or more terpenes into a reactor comprising Pt/C;

introducing $H_2$ into the reactor;

operating the reactor at a reaction temperature ranging from ambient temperature to 200° C. and under a reaction pressure ranging from 0 psig to 600 psig to form the jet fuel or the jet fuel blendstock comprising (i) at least one partially hydrogenated carbocyclic product selected from 4-isopropyl-1-methylcyclohex-1-ene, 5-isopropyl-1-methylcyclohex-1-ene, or a combination thereof, present in an amount ranging from 40% to an amount that is 95% or higher of the jet fuel or the jet fuel blendstock mixture and (ii) a fully hydrogenated form of the one or more terpenes; and isolating the jet fuel or the jet fuel blendstock, wherein the jet fuel or the jet fuel blendstock thereof exhibits an O-ring seal swelling value ranging from 5% to 25% v/v seal swell;

provided that if any of the one or more terpenes is limonene, then the feedstock comprises one or more terpenes other than limonene.

19. The method of claim 18, wherein the feedstock is obtained from dimerizing isoprene and one of the one or more terpenes is a limonene isomer.

20. The method of claim 18, wherein the method comprises isolating the jet fuel blendstock and the jet fuel blendstock is mixed with a base blendstock to provide a fuel blend that exhibits a seal swelling value ranging from 8% to 12% v/v seal swell when the jet fuel blendstock is present in the fuel blend in an amount of at least 10%.

* * * * *